US006991034B2

(12) United States Patent
Wilde

(10) Patent No.: US 6,991,034 B2
(45) Date of Patent: Jan. 31, 2006

(54) APPARATUS AND METHOD FOR ENHANCING PRODUCTIVITY OF NATURAL GAS WELLS

(75) Inventor: Glenn Wilde, Calgary (CA)

(73) Assignee: Optimum Production Technologies Inc., Calgary (CA)

( * ) Notice: Subject to any disclaimer, the term of this patent is extended or adjusted under 35 U.S.C. 154(b) by 141 days.

(21) Appl. No.: 10/657,227

(22) Filed: Sep. 9, 2003

(65) Prior Publication Data

US 2004/0200615 A1 Oct. 14, 2004

(30) Foreign Application Priority Data

Apr. 9, 2003 (CA) ..... 2424745

(51) Int. Cl.
*E21B 47/00* (2006.01)

(52) U.S. Cl. ..... 166/250.15; 166/91.1; 166/263; 166/309

(58) Field of Classification Search ..... 166/90.1, 166/91.1, 250.01, 250.15, 263, 309, 372, 166/401
See application file for complete search history.

(56) References Cited

U.S. PATENT DOCUMENTS 3,654,949 A * 4/1972 McMurry ..... 137/155
3,887,008 A 6/1975 Canfield
4,738,313 A 4/1988 McKee
4,989,671 A * 2/1991 Lamp ..... 166/53
5,911,278 A 6/1999 Reitz
5,915,478 A * 6/1999 Brown et al. ..... 166/329
6,158,508 A 12/2000 Lemetayer et al.
6,286,596 B1 9/2001 Schnatzmeyer et al.
6,293,341 B1 9/2001 Lemetayer
6,367,555 B1 4/2002 Senyard, Sr. et al.
6,454,002 B1 9/2002 Stokes et al.
6,629,566 B2 10/2003 Liknes
6,672,392 B2 1/2004 Reitz
6,745,815 B1 6/2004 Senyard, Sr. et al.
6,758,277 B2 * 7/2004 Vinegar et al. ..... 166/372
2003/0047308 A1 3/2003 Hirsch et al.

FOREIGN PATENT DOCUMENTS

GB 2355767 B1 9/2002
WO WO 00/75477 B1 12/2000

* cited by examiner

*Primary Examiner*—Zakiya Walker
(74) *Attorney, Agent, or Firm*—Donald V. Tomkins

(57) ABSTRACT

A natural gas production system prevents liquid accumulation in the wellbore and minimizes friction loading in the wellbore by maintaining production gas velocity above a critical minimum velocity. A pressurized gas is injected into the well to supplement the flow of production gas such that the velocity of the total gas flow up the well exceeds the critical velocity. A choke is fitted to the gas injection line, and total gas flows are measured by a flow meter. A flow controller compares the measured total gas flow rate against the critical flow rate, and determines a minimum gas injection rate required to maintain the total gas flow rate at or above the critical flow rate. The flow controller then adjusts the choke to achieve the desired gas injection rate. The injection gas may be recirculated production gas from the well, or a gas from a separate source.

42 Claims, 6 Drawing Sheets

APPARATUS AND METHOD FOR ENHANCING PRODUCTIVITY OF NATURAL GAS WELLS

FIELD OF THE INVENTION

The present invention relates to apparatus and methods of enhancing productivity in natural gas wells, and particularly in gas wells susceptible to liquid loading.

BACKGROUND OF THE INVENTION

Natural gas is commonly found in subsurface geological formations such as deposits of granular material (e.g., sand or gravel) or porous rock. Production of natural gas from these types of formations typically involves drilling a well a desired depth into the formation, installing a casing in the wellbore (to keep the well bore from sloughing and collapsing), perforating the casing in the production zone (i.e., the portion of the well that penetrates the gas-bearing formation) so that gas can flow into the casing, and installing a string of tubing inside the casing down to the production zone. Gas can then be made to flow up to the surface through a production chamber, which may be either the tubing or the annulus between the tubing and the casing.

Formation liquids, including water, oil, and/or hydrocarbon condensates, are generally present with natural gas in a subsurface reservoir. For reasons explained in greater detail hereinafter, these liquids must be lifted along with the gas. In order for this to happen, one of the following flow regimes must be present in the well:

Pressure-induced Flow

In a pressure-induced flow regime, the formation pressure (i.e., the pressure of the fluids flowing into the well) is greater than the hydrostatic pressure from the column of fluids (gas and liquids) in the production chamber. In other words, the formation pressure is sufficient to lift the liquids along with the gas. Pressure-induced flow occurs in wells producing from reservoirs having a non-depleting pressure; i.e., where the reservoir pressure is high enough that production from the reservoir results in no significant drop in formation pressure. This type of flow regime is common in reservoirs under water flood or having an active water drive providing pressure support. Conventional gas lift technology may be used to enhance flow in a pressure-induced flow regime by lightening the hydrostatic weight of total fluids in the production chamber.

Pressure-induced flow is most commonly associated with wells that are primarily oil-producing wells, and is rarely associated with primarily gas-producing wells.

Velocity-induced Flow

This type of flow occurs with gas reservoirs having a depleting pressure, and it is common in most gas reservoirs and all solution gas drive oil reservoirs. The present invention is concerned with velocity-induced flow, a general explanation of which follows.

In order to optimize total volumes and rates of gas recovery from a gas reservoir, the bottomhole flowing pressure should be kept as low as possible. The theoretically ideal case would be to have a negative bottomhole flowing pressure so as to facilitate 100% gas recovery from the reservoir, resulting in a final reservoir pressure of zero.

When natural gas is flowing up a well, formation liquids will tend to be entrained in the gas stream, in the form of small droplets. As long as the gas is flowing upward at or above a critical velocity (or "$V_{cr}$"—the value of which depends on various well-specific factors), the droplets will be lifted along with the gas to the wellhead, where the gas-liquid mixture may be separated using well-known equipment and methods. In this situation, the gas velocity provides the means for lifting the liquids; i.e., the well is producing gas by velocity-induced flow.

Formation pressures in virgin reservoirs of natural gas tend to be relatively high. Therefore, upon initial completion of a well, the gas will commonly rise naturally to the surface by velocity-induced flow provided that the characteristics of the reservoir and the wellbore are suitable to produce stable flow (meaning that the gas velocity at all locations in the production chamber remains equal to or greater than the critical velocity, $V_{cr}$—in other words, velocity-induced flow).

However, as wells penetrate the reservoir and gas reserves are removed, the formation pressure drops continuously, inevitably to a level too low to induce gas velocities high enough to sustain stable flow. Therefore, all flowing gas wells producing from reservoirs with depleting formation pressure eventually become unstable. Once the gas velocity has become too low to lift liquids, the liquids accumulate in the wellbore, and the well is said to be "liquid loaded". This accumulation of liquids results in increased bottomhole flowing pressures and reduced gas recoveries. In this situation, continued gas production from the well requires the use of mechanical methods and apparatus in order to remove liquids from the wellbore and to restore stable flow.

The prior art discloses numerous examples of methods and equipment directed to extending the productive life of gas wells in which gas velocities are insufficient to convey gas to the wellhead without artificial assistance, and which are therefore susceptible to liquid loading.

U.S. Pat. No. 3,887,008 (Canfield), issued Jun. 3, 1975, discloses a jet compressor which may be installed within the tubing inside a cased gas well, wherein the annulus is sealed with a packer near the bottom of the tubing. The jet compressor has a low-pressure inlet exposed to the bottom of the wellbore, such that it is in communication with the gas-bearing formation through which the well has been drilled. A pressurized gas (which may be natural gas) injected down the annulus enters an inlet port in the jet compressor, via appropriately positioned openings in the casing. The jet compressor has a throat section configured to induce supersonic flow of gas moving upwardly therethrough. The injected gas entering the jet compressor thus is accelerated upward within the tubing, thereby creating a venturi effect that induces a reduction in bottomhole pressure and a consequent drawdown on the gas-bearing formation.

U.S. Pat. No. 5,911,278 (Reitz), issued Jun. 15, 1999, discloses a technique wherein a production tubing string is installed inside a cased wellbore down to the production zone, with a string of flexible tubing (or "macaroni tubing") running down through the production tubing and terminating just above the bottom thereof. The casing is perforated in the production zone. The bottom of the production tubing is sealed off and fitted with a one-way valve that allows fluids to flow into the production tubing. There is no packer sealing off the annulus between the production tubing and the casing, so the annulus is in direct communication with the production zone of the well. Liquids present in the bottom of the well can therefore accumulate to similar levels in the macaroni tubing, the annulus between the macaroni tubing and the production tubing, and the annulus between the production tubing and the casing. The casing, production tubing, and macaroni tubing have separate valved connections to the suction manifold of a gas compressor near the wellhead, and to a wellhead production pipeline for formation liquids. As well, the production tubing and the casing have separate valved connections to the discharge manifold of the compressor.

In a situation where the casing, production tubing, and macaroni tubing all contain accumulations of liquids, the Reitz apparatus may operate in the "compression" cycle. The various valves of the apparatus are adjusted so as to open the production tubing to the discharge manifold (and close it to the suction manifold), to open the casing to the suction manifold (and close it to the discharge manifold), to close off the macaroni tubing from the suction manifold, and to close off all three of these components from the wellhead production line. The reduced pressure in the annulus between the casing and the production tubing (due to the suction from the compressor) causes additional formation fluids to enter the casing through the perforations. Pressurized gas flows into the production tubing from the discharge manifold, which because of the presence of the one-way valve causes the liquids to be evacuated from the production tubing into the macaroni tubing. At the same time, natural gas flows up to the compressor suction manifold through the annulus between the casing and the production tubing.

The compression cycle of the Reitz system is followed by a production cycle and an evacuation cycle, which are serially initiated by selective adjustment of the various control valves of the apparatus using an automatic controller of some type. These additional cycles are described in more detail in U.S. Pat. No. 5,911,278.

Perhaps the most common method of maintaining or restoring gas production in wells susceptible to liquid loading involves the use of a pump to remove liquids from the well. The pump may be a reciprocating pump operated by a "pump jack", but other well-known types of pump may also be used. In any event, the pump is used to remove accumulated liquids through the tubing string, thus relieving the hydrostatic pressure at the bottom of the wellbore. In accordance with principles discussed previously, this induces further gas flow from the formation into the well and up the annulus.

The prior art technologies described above have proven useful for extending the productive life of gas wells that might otherwise have been abandoned due to liquid loading, but they have a number of drawbacks and disadvantages. For example, the Canfield system uses a downhole jet compressor of complex construction. If this jet compressor malfunctions, it must be retrieved from the tubing and then repaired or replaced, in either case resulting in expense and lost production. The Canfield system also requires the use of packers at the bottom of the tubing string.

Although the Reitz system does not employ specialized downhole devices or packers as in the Canfield system, it requires an additional tubing string (i.e., the macaroni tubing) running inside the production tubing, plus a one-way valve at the bottom of the production tubing. Malfunction of the one-way valve will require removal and replacement, resulting in expense and lost production. Further drawbacks of the Reitz apparatus include the requirement for a complex array of valves connecting the various well chambers to the compressor's suction and discharge manifolds, plus the need for a controller to manipulate the valves according to the system's various cycles. It is also noteworthy that gas production using the Reitz system is cyclical, not continuous.

The use of pumps to remove accumulated liquids from gas wells also has disadvantages, most particularly including the cost of providing, installing, and maintaining the pump equipment. A conventional reciprocating pump requires a string of "sucker rods" virtually the full length of the well, and if a rod breakage occurs, the entire string may need to be removed for repair, with consequent expense and loss of gas production.

An alternative approach to removing accumulated liquids from a gas well could involve injection of a pressurized gas into the well. Gas could be injected into the annulus (or the tubing) under sufficiently high pressure to blow the liquids up the tubing (or the annulus) and out of the well, thereby reducing or eliminating the hydrostatic pressure at the bottom of the wellbore. It might be intuitively thought that the effectiveness of such gas injection would increase with higher injection rates and pressures, but this is not necessarily true. The flow of a gas inside a conduit, such as the tubing or annulus in a well, causes "friction loading" due to friction between the flowing gas and the inner surfaces of the conduit.

Friction loading inside a well casing or tubing string has essentially the same effect as hydrostatic pressure caused by liquid loading; i.e., it effectively increases the bottomhole pressure, thus inhibiting gas flow into the well. Flow-induced friction forces increase with the square of the gas velocity, so efforts to increase gas production from marginal wells by increasing gas injection pressures and velocities may actually be counterproductive and futile. It is apparent that any prior attempts to enhance or restore gas production using only gas injection have not met with practical success, possibly because the disadvantageous effects of increased injection rates were not fully appreciated.

For the foregoing reasons, there is a need for improved methods and apparatus for extending the production life of gas wells subject or susceptible to liquid loading, by reducing bottomhole pressures so as to induce increased gas flows into the well, and by providing means for maintaining gas velocities in the well at or above the critical velocity in order to prevent accumulation of liquids in the wellbore. There is also a need for such improved methods and apparatus which involve the injection of a pressurized gas into the well, but without inducing excessive friction loading in the well. In addition, there is a need for methods and apparatus capable of carrying out these functions on a continuous rather than cyclic or intermittent basis. There is a further need for such methods and apparatus which do not entail the installation of valves, packers, compressors, or other appurtenances down the well, and without requiring more than one string of tubing inside the well casing. There is an even further need for such methods and apparatus which do not require a complex array of valves and associated piping at the wellhead. The present invention is directed to these needs.

BRIEF SUMMARY OF THE INVENTION

In general terms, the present invention is a system for enhancing production of a gas well by maintaining a velocity-induced flow regime, thus providing for continuous removal of liquids from the well and preventing or mitigating liquid loading and friction loading of the well. In accordance with the invention, a supplementary pressurized gas may be injected into a first chamber of a gas well as necessary to keep the total upward gas flow rate in a second chamber of the well at or above a minimum flow rate needed to lift liquids within the upward gas flow. A cased well having a string of tubing may be considered as having two chambers, namely the bore of the tubing, and the annulus between the outer surface of the tubing and the casing. For present purposes, these two chambers will also be referred to as the injection chamber and the production chamber, depending on the function they serve in particular embodiments. As will be seen, the present invention may be practised with the injection and production chambers being the annulus and the tubing bore respectively, or vice versa.

The invention provides for a gas injection pipeline, for injecting the supplemental gas into a selected well chamber (i.e., the injection chamber), and further provides a throttling valve (also referred to as a "choke") for controlling the rate of gas injection, and, more specifically, to maintain a gas injection rate sufficient to keep the total gas flow rate of gas flowing up the other well chamber (i.e., the production chamber) at or above a set point established with reference to a critical flow rate. Strictly speaking, the critical flow rate is a well-specific gas velocity above which liquids will not drop out of an upward flowing gas stream. However, the critical flow rate may also be expressed in terms of volumetric flow based on the critical gas velocity and the cross-sectional area of the production chamber.

In accordance with the present invention, the critical flow rate for a particular well may be determined using methods or formulae well known to those skilled in the art. A "set point" (i.e., minimum rate of total gas flow in the production chamber) is then selected, for purposes of controlling the operation of the choke. The set point may correspond to the critical flow rate, but more typically will correspond to a value higher than the critical flow rate, in order to provide a margin of safety. Once the well has been brought into production, an actual total gas flow rate in the production chamber is measured. If the measured total gas flow rate (without gas injection) is at or above the set point, the choke will remain closed, and no gas will be injected into the well. However, if the measured total gas flow rate is below the set point, the choke will be opened so that gas is injected into the injection chamber at a sufficient rate to raise the total gas flow rate in the production chamber to a level at or above the set point.

The measurement of the gas flow rate in the production chamber may be made using a flow meter of any suitable type. Alternatively, the measurement may be made empirically, in trial-and-error fashion, by selective manual adjustment of the choke.

The process of measuring the total flow rate and adjusting the choke may be carried out on a substantially continuous basis. Alternatively, it may be carried out intermittently, at selected time intervals, and a timer may be used for this purpose.

As suggested above, the choke may be manually controlled, but in the preferred embodiment of the invention, a flow controller is used to adjust the choke as required. The flow controller may be a pneumatic controller. The flow controller may be set for the set point determined as previously described. If the total flow rate is at or less than the set point, the flow controller will adjust the choke to increase injection rate as necessary to increase the total flow rate to a level at or above the set point (i.e., so that the upward gas velocity in the production chamber is at or above $V_{cr}$). However, if the measured total flow rate is at or above the set point, there will be no need to adjust the gas injection rate, because the upward gas velocity in the production chamber should be high enough to lift liquids in the gas stream, so the choke setting will not need to be adjusted. Alternatively, if the total gas flow is significantly higher than the set point, the flow controller can adjust the choke so as to reduce the gas injection rate, but not so low that the total flow rate falls below or too close to the set point.

In one particular embodiment of the invention, the flow controller has a computer with a memory, and the set point may be stored in the memory. In the sense used in this document, a computer means any device capable of processing data, and may include a microprocessor. The computer is programmed and adapted to automatically receive total flow rate data from a flow meter, compare the measured total flow rate against the set point, determine a minimum gas injection rate, and then adjust the choke to achieve that minimum injection rate.

Accordingly, the present invention in one aspect is a method of producing natural gas from a well with a perforated casing extending into a subsurface production zone within a production formation, with a tubing string extending through the casing into the production zone above the bottom of the wellbore, with the casing defining an annulus between the tubing and the casing, and with the bottoms of the annulus and casing both being open. The method includes the steps of determining a minimum total gas flow rate for the well; injecting a pressurized injection gas into an injection chamber selected from the annulus and tubing, so as to induce flow of a gas stream up a production chamber selected from the annulus and the tubing (the production chamber not being the injection chamber), with the gas stream comprising a mixture of the injection gas and production gas entering the wellbore from the formation through the casing perforations; measuring the actual total gas flow rate in the production chamber; comparing the measured total gas flow rate to the minimum total flow rate; determining the minimum gas injection rate required to maintain the total flow rate at or above the minimum total flow rate, according to whether and by how much the measured total flow rate exceeds the minimum total flow rate; and adjusting the gas injection rate to a rate not less than the minimum gas injection rate.

In another aspect, the invention is an apparatus for producing natural gas from a well having a well with a perforated casing extending into a subsurface production zone within a production formation, with a tubing string extending through the casing into the production zone above the bottom of the wellbore, with the casing defining an annulus between the tubing and the casing, and with the bottoms of the annulus and casing both being open. In this aspect of the invention, the apparatus includes a gas compressor having a suction manifold and a discharge manifold; an upstream gas production pipeline having a first end connected in fluid communication with the upper end of a production chamber selected from the tubing and the annulus, and a second end connected in fluid communication with the suction manifold of the compressor; a downstream gas production pipeline having a first end connected in fluid communication with the discharge manifold; a gas injection pipeline having a first end connected to and in fluid communication with the production pipeline at a point downstream of the compressor, and a second end connected in fluid communication with an injection chamber selected from the tubing and the annulus, said injection chamber not being the production chamber; and a choke, for regulating the flow of gas in the injection pipeline.

In a further aspect, the invention is an apparatus for producing natural gas from a well having a well with a perforated casing extending into a subsurface production zone within a production formation, with a tubing string extending through the casing into the production zone above the bottom of the wellbore, with the casing defining an annulus between the tubing and the casing, with the bottoms of the annulus and casing both being open, and with a gas production pipeline connected in fluid communication with the upper end of a production chamber selected from the tubing and the annulus. In this aspect of the invention, the apparatus includes a gas injection pipeline having a first end in fluid communication with a source of pressurized injection gas, and a second end in fluid communication with an injection chamber selected from the tubing and the annulus, said injection chamber not being the production chamber; gas injection means, for pumping injection gas through the injection pipeline into the injection chamber; and a choke associated with the injection pipeline, for regulating the flow of gas in the injection pipeline.

In a yet further aspect, the invention is an apparatus for use in producing natural gas from a well having a well with a perforated casing extending into a subsurface production zone within a production formation, with a tubing string extending through the casing into the production zone above the bottom of the wellbore, with the casing defining an annulus between the tubing and the casing, with the bottoms of the annulus and casing both being open, and with a gas production pipeline connected in fluid communication with the upper end of a production chamber selected from the tubing and the annulus. In the aspect of the invention, the apparatus includes a gas injection pipeline having a first end connected in fluid communication with a source of pressurized injection gas, and a second end connected in fluid communication with an injection chamber selected from the tubing and the annulus, said injection chamber not being the production chamber; plus a choke associated with the injection pipeline, for regulating the flow of gas in the injection pipeline.

In a still further aspect, the invention is an apparatus for producing natural gas from a well having a well with a perforated casing extending into a subsurface production zone within a production formation, with a tubing string extending through the casing into the production zone above the bottom of the wellbore, with the casing defining an annulus between the tubing and the casing, and with the bottoms of the annulus and casing both being open. In this aspect of the invention, the apparatus includes a gas compressor having a suction manifold and a discharge manifold; an upstream gas production pipeline having a first end connected in fluid communication with the upper end of a production chamber selected from the tubing and the annulus, and a second end connected in fluid communication with the suction manifold of the compressor; a downstream gas production pipeline having a first end connected in fluid communication with the discharge manifold; an auxiliary pipeline having a first end connected in fluid communication with the production pipeline at a point upstream of the compressor, and a second end connected in fluid communication with the production pipeline at a point downstream of the compressor; a gas injection pipeline having a first end connected in fluid communication with the auxiliary pipeline, and a second end connected in fluid communication with an injection chamber selected from the tubing and the annulus, said injection chamber not being the production chamber; a choke mounted in the injection pipeline, for regulating the flow of gas in the injection pipeline; a first flow valve mounted in the auxiliary pipeline between the point where the auxiliary pipeline connects with the production pipeline upstream of the compressor and the point where the injection pipeline connects with the auxiliary pipeline; and a second flow valve mounted in the auxiliary pipeline between the point where the auxiliary pipeline connects with the production pipeline downstream of the compressor and the point where the injection pipeline connects with the auxiliary pipeline;

In various embodiments, the apparatus of the invention may also include a flow meter, for measuring (either directly or indirectly) gas flow rates in the production chamber, plus a flow controller associated with the flow meter, said flow controller having means for operating the choke. The flow controller may be pneumatically-actuated. In preferred embodiments, the flow controller may incorporate or be associated with a computer having a memory, for receiving gas flow data from the meter, comparing measured gas flow rates against the critical gas flow rate, and determining a minimum gas injection rate needed to maintain the total gas flow rate in the production chamber at or above the critical flow rate, according to whether and by how much the measured gas flow rate exceeds the critical flow rate.

In the preferred embodiments, the injection gas is recirculated gas from the well. In alternative embodiments, the injection gas may be propane or other hydrocarbon gas provided from a source such as a pressurized gas storage tank. The injection gas may also be a substantially inert gas such as nitrogen.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
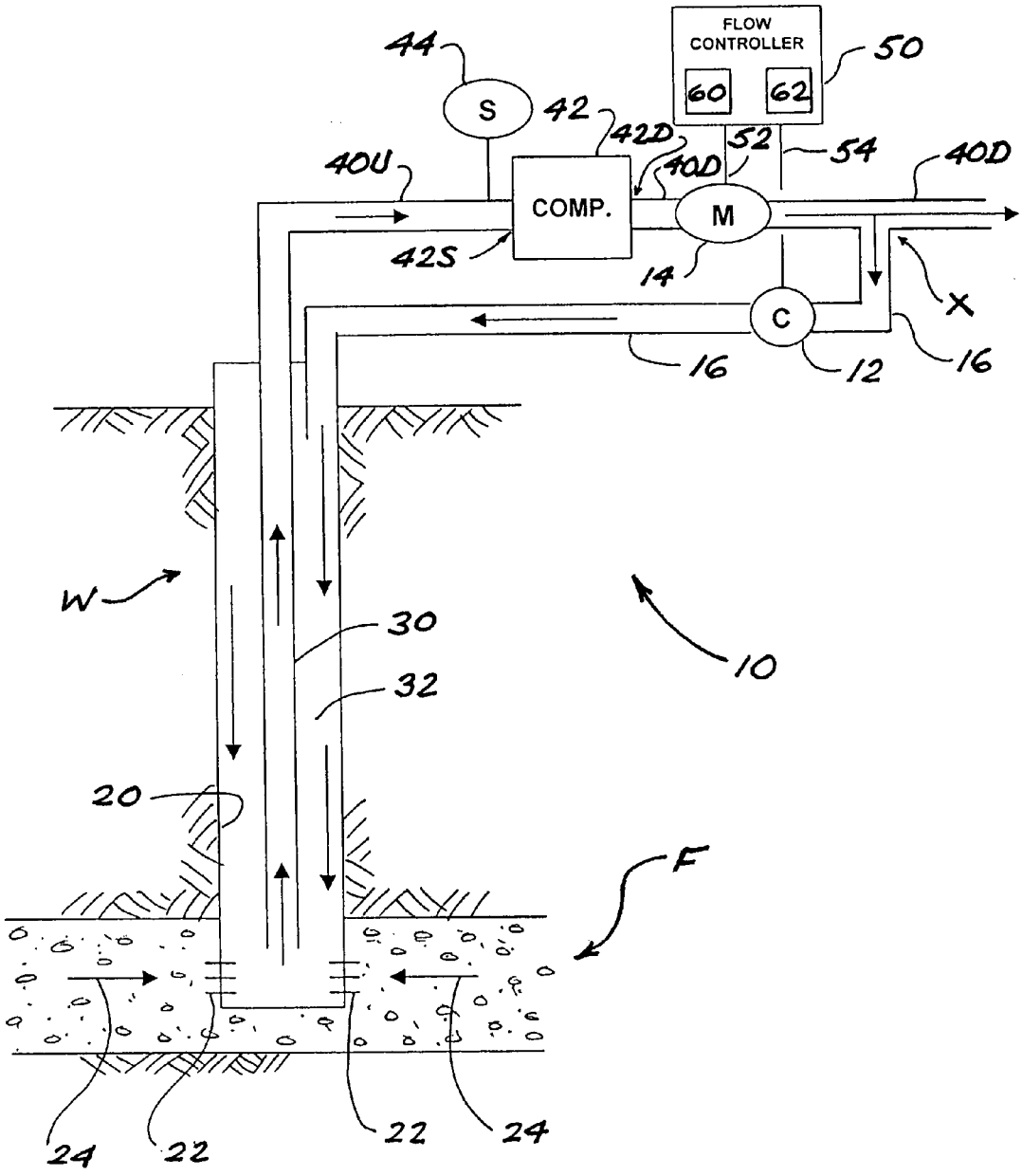
FIG. 1 is a schematic view of a well producing natural gas in accordance with an embodiment of the invention enabling production of gas up the tubing and injection of recirculated well gas into the annulus.

The basic elements of the present invention may be understood from reference to the Figures, wherein the apparatus of the invention is generally designated by reference numeral 10. A well W penetrates a subsurface formation F containing natural gas (typically along with water and crude oil in some proportions). The well W is lined with a casing 20 which has a number of perforations conceptually illustrated by short lines 22 within a production zone (generally corresponding to the portion of the well penetrating the formation F). As conceptually indicated by arrows 24, formation fluids including gas, oil, and water may flow into the well through the perforations 22. A string of tubing 30 extends inside the casing 20, terminating at a point within the production zone. The bottom end of the tubing 30 is open such that fluids in the wellbore may freely enter the tubing 30. An annulus 32 is formed between the tubing 30 and the casing 20.

As previously explained, the tubing 30 and the annulus 32 may be considered as separate chambers of the well W. In accordance with the present invention, a selected one of these chambers serves as the "production chamber" through which gas is lifted from the bottom of the well W to the surface, while the other chamber serves as the "injection chamber", the purpose and function of which are explained in greater detail hereinafter. For purposes of the embodiment illustrated in FIG. 1, the tubing 30 serves as the production chamber, and the annulus 32 serves as the injection chamber, whereas in the embodiment illustrated in FIG. 2, the tubing 30 serves as the injection chamber, and the annulus 32 serves as the production chamber. In the alternative embodiments shown in FIG. 3 and FIG. 5 (discussed in further detail hereinafter), it is in fact possible for both the tubing 30 and the annulus 32 to serve as production chambers, in which situations there will be no injection chamber as such.

It should be noted that, to facilitate illustration and understanding of the invention, the Figures are not drawn to scale. The diameter of the casing 20 is commonly in the range of 4.5 to 7 inches, and the diameter of the tubing 30 is commonly in the range of 2.375 to 3.5 inches, while the well W typically penetrates hundreds or thousands of feet into the ground. It should also be noted that except where indicated otherwise, the arrows in the Figures denote the direction of gas flow within various components of the apparatus.

In the well configuration shown in FIG. 1, the tubing 30 serves as the production chamber to carry gas from the well W to an above-ground production pipeline 40, which has an upstream section 40U and a downstream section 40D. The tubing 30 connects in fluid communication with one end of the upstream section 40U, and the other end of the upstream section 40U is connected to the suction manifold 42S of a gas compressor 42. The downstream section 40D of the production pipeline 40 connects at one end to the discharge manifold 42D of the compressor 42 and continues therefrom to a gas processing facility (not shown). A gas injection pipeline 16, for diverting production gas from the production pipeline 40 for injection into the injection chamber (i.e., the annulus 32, in FIG. 1), is connected at one end to the downstream section 40D of the production pipeline 40 at a point X, and at its other end to the top of the injection chamber. Also provided is a throttling valve (or "choke") 12, which is operable to regulate the flow of gas from the production pipeline 40 into the injection pipeline 16 and the injection chamber.

The choke 12 may be of any suitable type. In a fairly simple embodiment of the apparatus, the choke 12 may be of a manually-actuated type, which may be manually adjusted to achieve desired rates of gas injection, using trial-and-error methods as may be necessary or appropriate; with practice, a skilled well operator can develop a sufficiently practical ability to determine how the choke 12 needs to be adjusted to achieve stable gas flow in the production chamber, without actually quantifying the necessary minimum gas injection rate or the flow rate in the production chamber. Alternatively, the choke 12 may be an automatic choke; e.g., a Kimray® Model 2200 flow control valve.

In the preferred embodiment, however, a flow controller 50 is provided for operating the choke 12. Also provided is a flow meter 14 adapted to measure the rate of total gas flow up the production chamber, and to communicate that information to the flow controller 50. The flow controller 50 may be a pneumatic controller of any suitable type; e.g., a Fisher™ Model 4194 differential pressure controller.

In accordance with the method of the invention, a critical gas flow rate is determined. The critical flow rate, which may be expressed in terms of either gas velocity or volumetric flow, is a parameter corresponding to the minimum velocity $V_{cr}$ that must be maintained by a gas stream flowing up the production chamber (i.e., the tubing 30, in FIG. 1) in order to carry formation liquids upward with the gas stream (i.e., by velocity-induced flow). This parameter is determined in accordance with well-established methods and formulae taking into account a variety of quantifiable factors relating to the well construction and the characteristics of formation from which the well is producing. A minimum total flow rate (or "set point") is then selected, based on the calculated critical flow rate, and flow controller 50 is set accordingly. The selected set point will preferably be somewhat higher than the calculated critical rate, in order to provide a reasonable margin of safety, but also preferably not significantly higher than the critical rate, in order to minimize friction loading in the production chamber.

If the total flow rate measured by the meter 14 is less than the set point, the flow controller 50 will adjust the choke 12 to increase the gas injection rate if and as necessary to increase the total flow rate to a level at or above the set point. If the total flow rate is at or above the set point, there may be no need to adjust the choke 12. The flow controller 50 may be adapted such that if the total gas flow is considerably higher than the set point, the flow controller 50 will adjust the choke 12 to reduce the gas injection rate, thus minimizing the amount of gas being recirculated to the well through injection, and maximizing the amount of gas available for processing and sale.

In one particular embodiment, the flow controller 50 has a computer with a microprocessor (conceptually illustrated by reference numeral 60) and a memory (conceptually illustrated by reference numeral 62). The flow controller 50 also has a meter communication link (conceptually illustrated by reference numeral 52) for receiving gas flow measurement data from the meter 14.

The meter communication link 52 may comprise a wired or wireless electronic link, and may comprise a transducer. The flow controller 50 also has a choke control link (conceptually illustrated by reference numeral 54), for communicating a control signal from the computer 60 to a choke control means (not shown) which actuates the choke 12 in accordance with the control signal from the computer. The choke control link 54 may comprise a mechanical linkage, and may comprise a wired or wireless electronic link.

Using this embodiment of the apparatus, the set point is stored in the memory 62. The computer 60 receives a signal from the meter 14 (via the meter communication link 52) corresponding to the measured total gas flow rate in the production chamber, and, using software programmed into the computer 60, compares this value against the set point. The computer 60 then calculates a minimum injection rate at which supplementary gas must be injected into the injection chamber, or to which the injection rate must be increased in order to keep the total flow rate at or above the set point. This calculation takes into account the current gas injection rate (which would be zero if no gas is being injected at the time). If the measured total gas flow is below the set point, the computer 60 will convey a control signal, via the choke control link 54, to the choke control means, which in turn will adjust the choke 12 to deliver injection gas, at the calculated minimum injection rate, into the injection pipeline 16, and thence into the injection chamber of the well (i.e., the annulus 32, in FIG. 1). If the measured total gas flow equals or exceeds the set point, no adjustment of the choke 12 will be necessary, strictly speaking.

However, the computer 60 may also be programmed to reduce the injection rate if it is substantially higher than the set point, in order to minimize the amount of gas being recirculated to the well W, thus maximizing the amount of gas available for processing and sale, as well as to minimize friction loading. In fact, situations may occur in which there effectively is a "negative" gas injection rate; i.e., where rather than having gas being injected downward into the well through a selected injection chamber, gas is actually flowing to the surface through both the tubing 30 and the annulus 32, such as in accordance with the alternative embodiment illustrated in FIG. 3. This situation could occur when formation pressures are so great that the upward gas velocity in the selected production chamber is not only high enough to maintain a velocity-induced flow regime, but also so high that excessive friction loading develops in the production chamber. In this scenario, gas production would be optimized by producing gas up both chambers, thus reducing gas velocities and resultant friction loading (provided of course that the gas velocity—which will be naturally lower than when producing through only one chamber—remains above $V_{cr}$ at all points in at least one of the chambers; i.e., so that there is stable flow in at least one chamber).

Figure 3:
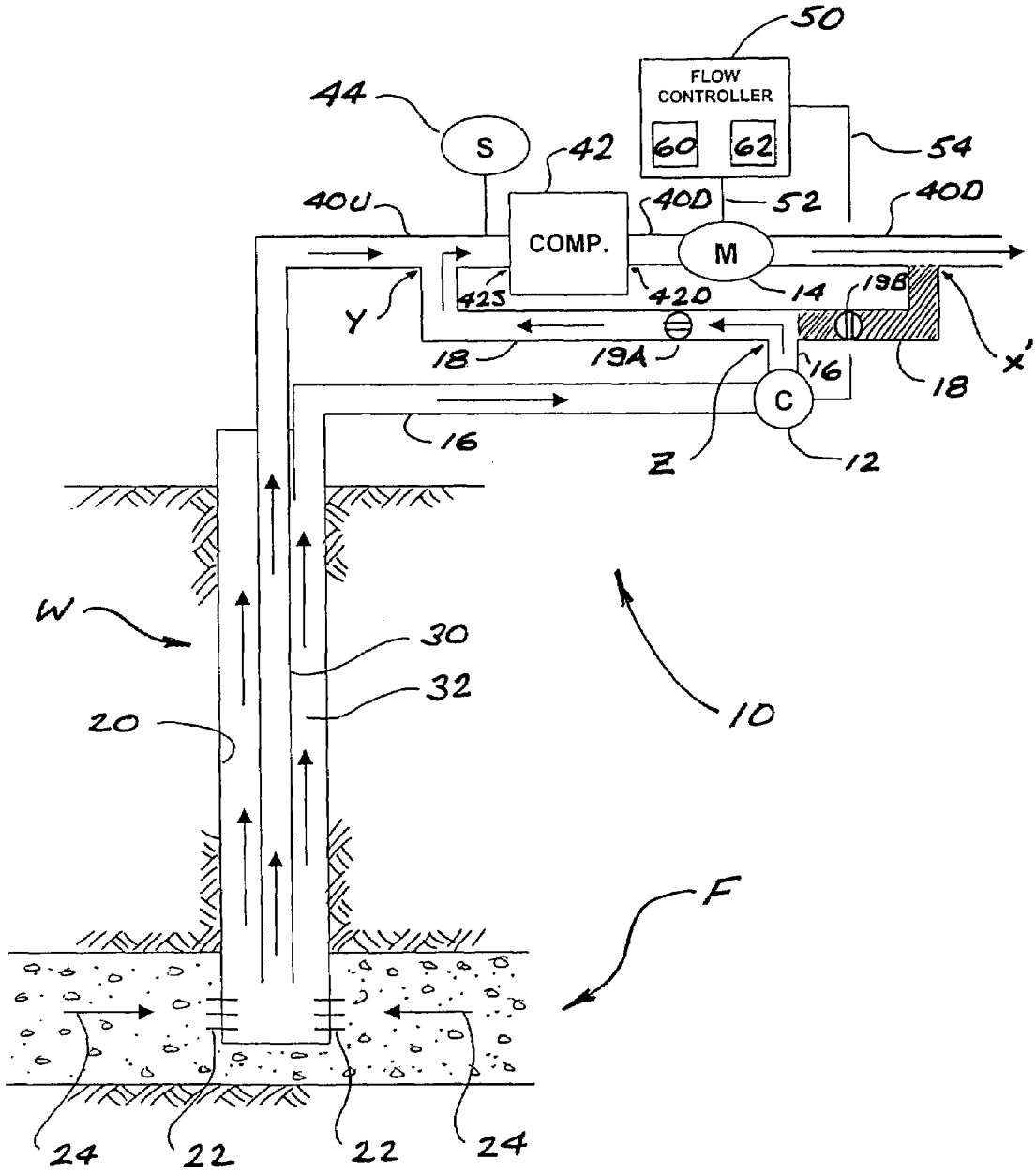
FIG. 3 is a schematic view of a well producing natural gas in accordance with an alternative embodiment, configured to enable production of gas up the tubing and the annulus simultaneously.

In the embodiment shown in FIG. 3, the apparatus is generally similar to that shown in FIG. 1, but with the addition of an auxiliary pipeline 18 connected in fluid communication between a point Y on the upstream section 40U of the production pipeline 40 and a point X' on the downstream section 40D. The injection pipeline 16 is connected in fluid communication between the top of the annulus 32 and a point Z along the length of the auxiliary pipeline 18. The choke 12 is mounted at a selected point along the length of the injection pipeline 16. A first flow valve 19A is mounted in the auxiliary pipeline 18 between points Y and Z, and a second flow valve 19B is mounted in the auxiliary pipeline 18 between points X' and Z. As illustrated in FIG. 3, when the first flow valve 19A is open and the second flow valve 19B is closed, gas can flow from the annulus 32 through the injection pipeline 16 (not being used as such) and through the auxiliary pipeline 18, and then into the upstream section 40U of the production pipeline 40. In this way, the gas flow from the annulus 32 merges with the gas flow from the tubing 30 at point Y upstream of the compressor 40, and there will be no gas flow in the section of the auxiliary pipeline 18 between points X' and Z (shown cross-hatched in FIG. 3). In this method of operation, the choke 12 may be used to control the rate of gas flow up the annulus 32.

Figure 4:
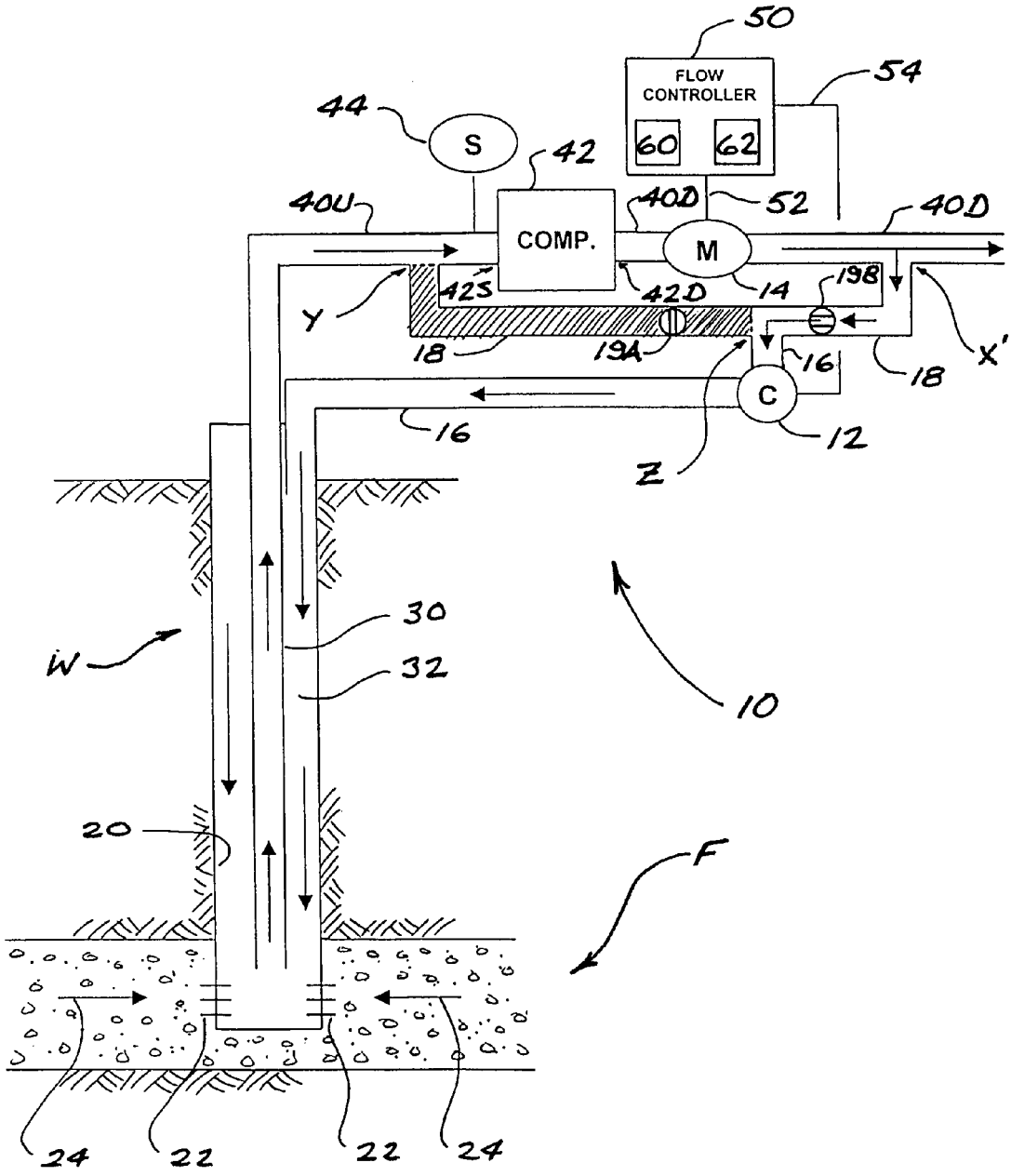
FIG. 4 is a schematic view the well producing natural gas in accordance with the embodiment shown in FIG. 3, configured to enable production of gas up the tubing and injection of recirculated well gas into the annulus.

Should operating conditions change such that it becomes desirable to produce gas through the tubing 30 only, and to inject gas into the annulus 32, this is readily accomplished by closing the first flow valve 19A and opening the second flow valve 19B, as illustrated in FIG. 4. With the flow valves so configured, the operation of the well becomes essentially the same as previously described in the context of the embodiment shown in FIG. 1, with no gas flow in the section of the auxiliary pipeline 18 between points Y and Z (shown cross-hatched in FIG. 4).

Figure 2:
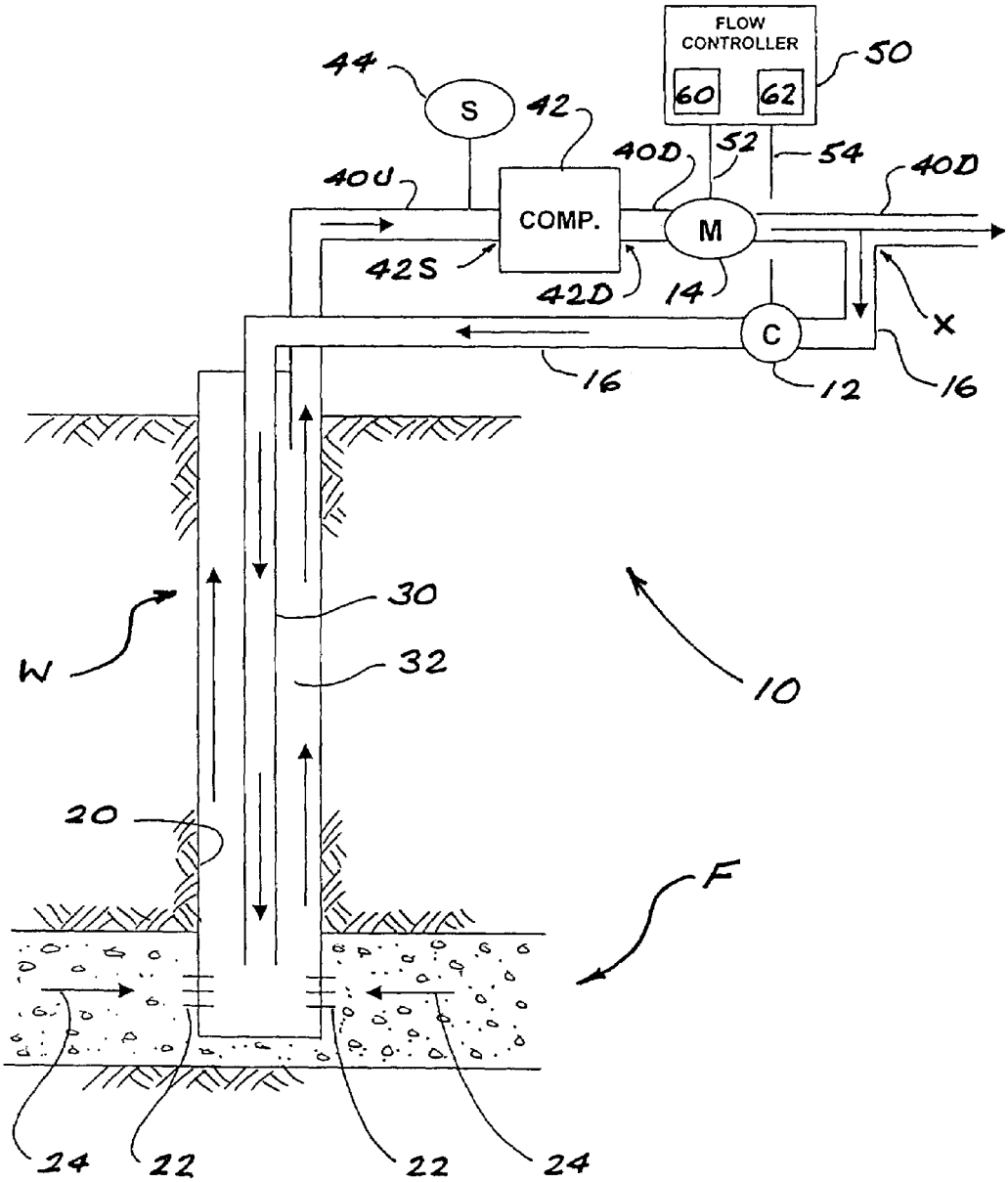
FIG. 2 is a schematic view of a well producing natural gas in accordance with an embodiment of the invention enabling production of gas up the annulus and injection of recirculated well gas into the tubing.
Figure 5:
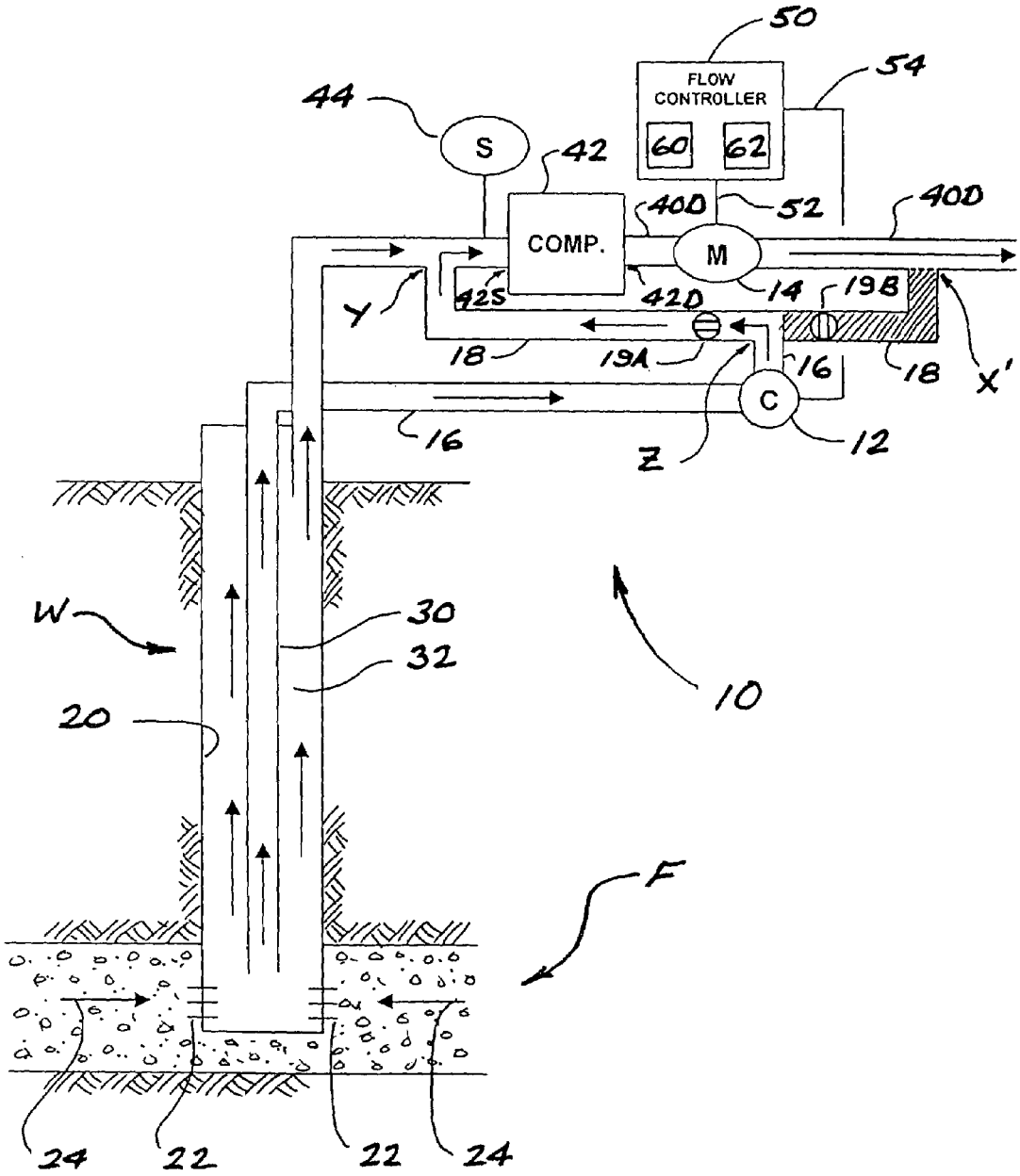
FIG. 5 is a schematic view of a well producing natural gas in accordance with a further alternative embodiment, configurable to enable production of gas up the tubing and the annulus simultaneously, or to enable production of gas up the annulus and injection of recirculated well gas into the tubing.

As illustrated in FIG. 5, the apparatus of the embodiment shown in FIG. 2 could be similarly adapted, with the addition of an auxiliary pipeline 18 and flow valves 19A and 19B. FIG. 5 shows flow valve 19A in the open position and flow valve 19B in the closed position, with gas being producted up both the tubing 30 and the casing 32. It will be readily appreciated that if valve 19A is closed and flow valve 19B is open, the operation of the well becomes essentially the same as previously described in the context of the embodiment shown in FIG. 2.

Alternatively, it may be feasible in some circumstances to alleviate the friction loading by switching the functions of the tubing 30 and the casing 32. For example, in a situation where the tubing 30 is initially serving as the production chamber (as in FIG. 1), and the cross-sectional flow area of the tubing 30 is considerably less than that of the annulus 32, excessive friction loading will be more likely to develop in the tubing 30 than in the annulus 32. In that case, switching production to the annulus 32 may solve the problem, provided that the geometry of the well bore is such that the gas velocity up the annulus remains high enough to maintain velocity-induced flow. Of course if the velocity is not sufficient under natural conditions, it may be possible to address this condition by injecting gas down the tubing 30 in accordance with the embodiment illustrated in FIG. 2, in order to increase the gas velocity in the annulus 32.

As previously described, FIG. 1 and FIG. 2 illustrate alternative configuration of the well components, in which the production chamber is the tubing 30 and the injection chamber is the annulus 32, and vice versa. However, in either configuration, the components of the apparatus of the invention 10 and the operation thereof are essentially the same. The decision to implement one configuration in preference to the other will generally depend on a number of variable factors relating to the particular characteristics of the well in question.

Although the flow meter 14 is illustrated in the Figures as being located downstream of the compressor 42, it will be appreciated that other embodiments are possible in which the flow meter 14 is located at a point upstream of the compressor 42, without departing from the operative principles and scope of the invention. Similarly, although the choke 12 is illustrated in FIG. 1 and FIG. 2 as being located in the injection pipeline 16, it could be located elsewhere in the system with similar function and effect. To provide one example, it may be desirable and beneficial in those configurations of the apparatus to locate the choke 12 at the junction between the injection pipeline 16 and the production pipeline 40 (point X in FIG. 1 and FIG. 2). In other situations, it may be desirable to locate the choke 12 somewhere in the production pipeline 40 downstream of point X. In unillustrated alternative configurations of the embodiments shown in FIG. 1 and FIG. 2, the choke 12 would be located downstream of point X, with the flow meter 14 being downstream of the choke 12. In these configurations, the flow meter 14 could be a "sales meter" used to measure the net flow of production gas (or "sales gas") to the processing facility. The gas injection rate could then be controlled by regulating the flow of sales gas; i.e., the volumetric injection rate would equal the flow rate of gas leaving the discharge manifold 42D of the compressor 42 minus the sales gas flow rate.

In further unillustrated variants of the embodiments shown in FIG. 1 and FIG. 2, a back-pressure valve 46 is mounted in the downstream section 42D of the production pipeline 40 downstream of point X. If the gathering pressure in the system (i.e., the pressure in the downstream section 40D) is lower than the injection pressure (i.e., the pressure in the injection pipeline 16 where it connects to the injection chamber of the well W), it will be impossible to inject gas into the well. In this situation, the back-pressure can be used to restrict the sales gas flow rate, thus increasing the gathering pressure. If gathering pressure is raised to a level above the injection pressure, gas can then be injected into the well W upon appropriate adjustment of the choke 12.

Figure 6:
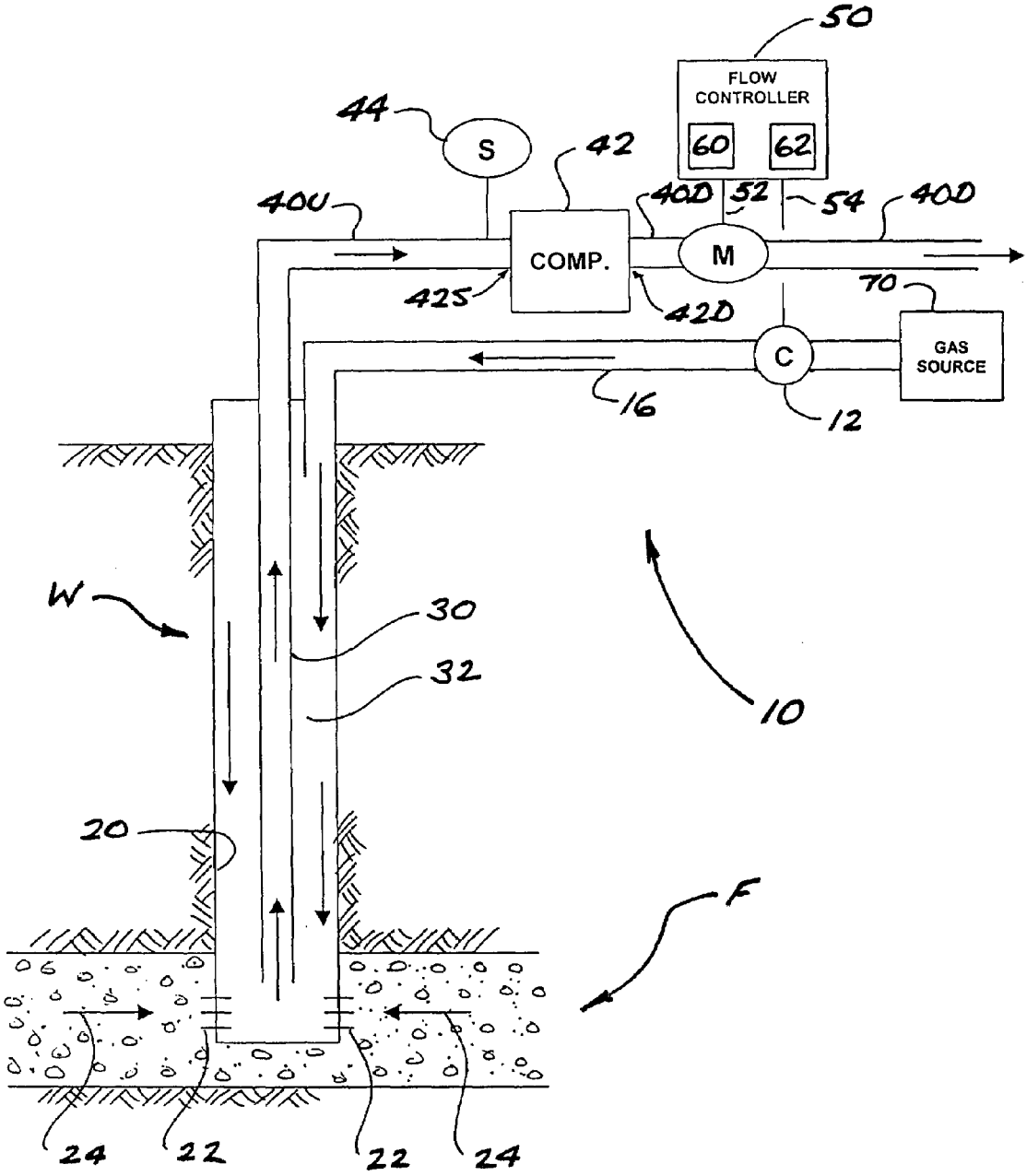
FIG. 6 is a schematic view of a well producing natural gas in accordance with another alternative embodiment of the invention enabling injection of a supplemental gas from a source other than the well.

FIG. 6 illustrates another embodiment of the invention, in which the injection gas is provided from a separate gas source (conceptually denoted by reference numeral 70), rather than being provided by recirculating production gas from the well W. To provide one example, the injection gas could be provided from a pressurized storage tank. The injection gas could be a hydrocarbon gas such as propane, or a substantially inert gas such as nitrogen. In such alternative embodiments, the injection pipeline 16 would run from the storage tank (or other gas source) to the injection chamber of the well W, and the choke 12 would be installed in association with the injection pipeline 16.

In certain situations, the well W may be liquid loaded when it is desired to put the present invention into service. This may entail the additional preparatory step of removing all or a substantial portion of the liquids from the wellbore before the method and apparatus of the invention may be used with optimal effect. There are many known ways of removing liquids from a wellbore (e.g., swabbing). However, if the characteristics (e.g., formation pressure and porosity) of the production formation are suitable, one method that may be used effectively with the apparatus of the present invention involves closing off the production chamber and injecting gas into the injection chamber at a pressure sufficiently greater than the formation pressure, such that the liquids are forced back into the formation through the perforations 22 in the liner 20. Alternatively, gas could be injected down both chambers for this purpose (this alternative would of course entail an appropriately valved connection between the injection pipeline 16 and the production chamber).

As previously discussed herein, it is desirable to minimize the bottomhole flowing pressure in order to optimize gas recovery and flow rates, and in the ideal case the bottomhole flowing pressure would be negative. However, negative pressures within a gas line would present an inherent problem, because any leak in the line would allow the entry of air, creating a risk of explosion should the air/gas mixture be exposed to a source of ignition. To obtain the advantages of negative gas pressures while avoiding explosion hazards, an alternative embodiment of the apparatus of the present invention includes an oxygen sensor 44 connected into the production pipeline 40. The oxygen sensor 44 is adapted to detect the presence of oxygen inside the production pipeline 40, and to shut down the compressor 42 immediately upon the detection of oxygen. This embodiment thus safely facilitates the use of high compressor suction so as to induce negative bottomhole flowing pressures. As shown in the Figures, the oxygen sensor 44 is preferably located upstream of the compressor 42, where gas pressure and temperature are considerably lower than downstream of the compressor 42, thus minimizing or eliminating the risk of autoignition in the event of oxygen entering the production pipeline 40.

The advantages and benefits of the present invention in various applications will be apparent to those skilled in the art. The primary benefit is that production chamber pressures may be reduced and kept at substantially constant levels, with gas flow rates in the production chamber also being kept substantially constant and above the critical rate. The invention thus facilitates stable flow even at production rates as low as 1 mcf/d (1,000 cubic feet per day). The net production rate from a well (i.e., gas flow available for processing and sale) will be the difference between the total gas flow rate (in the production chamber) and the injection rate. Therefore, stable flow at such low rates (which is difficult or impossible to achieve using prior art technology) is readily achieved with the present invention by controlling the amount of gas being recirculated through injection, so as to keep total flow rate at or above the critical rate.

An incidental benefit of the invention is that the gas from the well is heated as it goes through the compressor, so the injection and circulation of this heated gas through the well helps reduce or eliminate the need for injection of methanol, glycol, or other anti-freeze chemicals to prevent well freeze-off. As well, injection of hot gas prevents, reduces, removes wax build-up in the casing and tubing. The benefits of the invention can also be enhanced using well-known methods of reducing liquid hold-up in the gas flowing up the production chamber, such as by using free-cycle plunger lift and soap injection.

It will be readily appreciated by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A method of producing natural gas from a well extending from ground surface into a subsurface production zone within a production formation, wherein:

(a) the wellbore is lined with a casing, said casing having perforations in the production zone;

(b) a tubing string extends through the casing and terminates adjacent to the production zone above the bottom of the wellbore; and (c) said casing defines an annulus between the tubing and the casing, the bottoms of said annulus and casing being in fluid communication with the well bore;

said method comprising the steps of:

(d) determining a minimum total gas flow rate for the well;

(e) injecting a pressurized injection gas into an injection chamber selected from the annulus and tubing, so as to induce flow of a gas stream up a production chamber selected from the annulus and the tubing, said production chamber not being the injection chamber, said gas stream comprising a mixture of the injection gas and production gas entering the wellbore from the formation through the casing perforations;

(f) measuring the actual total gas flow rate in the production chamber;

(g) comparing the measured total gas flow rate to the minimum total flow rate;

(h) determining the minimum gas injection rate required to maintain the total flow rate at or above the minimum total flow rate, according to whether and by how much the measured total flow rate exceeds the minimum total flow rate; and (i) adjusting the gas injection rate to a rate not less than the minimum gas injection rate.

2. The method of claim 1 wherein the injection gas is a hydrocarbon gas.

3. The method of claim 2 wherein the hydrocarbon gas is recirculated production gas from the well.

4. The method of claim 1 wherein at least one of the steps of:

(a) measuring the actual total gas flow rate;

(b) comparing the measured total flow rate to the minimum total flow rate;

(c) determining a minimum gas injection rate; and (d) adjusting the gas injection rate;

is repeated at selected time intervals.

5. The method of claim 1 wherein the steps of:

(a) measuring the actual total gas flow rate;

(b) comparing the measured gas flow rate to the minimum total flow rate;

(c) determining a minimum gas injection rate; and (d) adjusting the gas injection rate;

are carried out empirically in trial-and-error fashion by manual adjustment of a throttling valve adapted to regulate the gas injection rate.

6. The method of claim 1 wherein the step of determining a minimum total flow rate is repeated at selected time intervals.

7. The method of claim 1 used in association with a liquid loaded well, and further comprising the step of injecting gas into the well under sufficient pressure as to force a portion of the liquids accumulated in the bottom of the wellbore through the casing perforations and back into the formation.

8. An apparatus for use in producing natural gas from a well extending from ground surface into a subsurface production zone within a production formation, wherein:

(a) the wellbore is lined with a casing, said casing having perforations in the production zone;

(b) a tubing string extends through the casing and terminates adjacent to the production zone above the bottom of the wellbore; and (c) said casing defines an annulus between the tubing and the casing, the bottoms of said annulus and casing being in fluid communication with the well bore;

said apparatus comprising:

(d) a gas compressor having a suction manifold and a discharge manifold;

(e) an upstream gas production pipeline having a first end connected in fluid communication with the upper end of a production chamber selected from the tubing and the annulus, and a second end connected in fluid communication with the suction manifold of the compressor;

(f) a downstream gas production pipeline having a first end connected in fluid communication with the discharge manifold;

(g) a gas injection pipeline having a first end connected to and in fluid communication with the production pipeline at a point downstream of the compressor, and a second end connected in fluid communication with an injection chamber selected from the tubing and the annulus, said injection chamber not being the production chamber; and (h) a choke, for regulating the flow of gas in the injection pipeline.

9. The apparatus of claim 8, further comprising a flow meter for measuring gas flow in the production chamber.

10. The apparatus of claim 9, further comprising a flow controller associated with the flow meter, said flow controller having means for operating the choke.

11. The apparatus of claim 10 wherein the flow controller is a pneumatically-actuated flow controller.

12. The apparatus of claim 10 wherein the flow controller comprises a computer with a memory, and wherein:

(a) the flow controller is adapted to receive gas flow data from the flow meter, corresponding to total gas flow rates in the production chamber;

(b) the memory is adapted to store a minimum total flow rate;

(c) the computer is programmed to:

c.1 compare a total gas flow rate measured by the meter against the minimum total flow rate; and c.2 determine a minimum gas injection rate necessary to maintain the total gas flow rate in the production chamber at or above the minimum total flow rate; and (d) the flow controller is adapted to automatically set the choke to permit gas flow into the injection chamber at a rate not less than the minimum gas injection rate.

13. The apparatus of claim 9 wherein the meter is installed in the production pipeline at a point downstream of the compressor.

14. The apparatus of claim 9 wherein the meter is installed in the production pipeline at a point upstream of the compressor.

15. The apparatus of claim 8 wherein the production chamber is the tubing, and the injection chamber is the annulus.

16. The apparatus of claim 8 wherein the production chamber is the annulus, and the injection chamber is the tubing.

17. The apparatus of claim 8, further comprising an oxygen sensor adapted to detect the presence of oxygen within the production pipeline and to automatically shut down the compressor upon so detecting oxygen.

18. The apparatus of claim 8, further comprising a back-pressure valve in the production pipeline at a point downstream of the intersection between the gas injection pipeline and the production pipeline.

19. The apparatus of claim 8 wherein the choke is located in the production pipeline at a point downstream of the point where the gas injection pipeline connects to the production pipeline.

20. An apparatus for use in producing natural gas from a well extending from ground surface into a subsurface production zone within a production formation, wherein:

(a) the wellbore is lined with a casing, said casing having perforations in the production zone;

(b) a tubing string extends through the casing and terminates adjacent to the production zone above the bottom of the wellbore;

(c) said casing defines an annulus between the tubing and the casing, the bottoms of said annulus and casing being in fluid communication with the well bore; and (d) a gas production pipeline is connected in fluid communication with the upper end of a production chamber selected from the tubing and the annulus;

said apparatus comprising:

(e) a gas injection pipeline having a first end in fluid communication with a source of pressurized injection gas, and a second end in fluid communication with an injection chamber selected from the tubing and the annulus, said injection chamber not being the production chamber;

(f) gas injection means, for pumping injection gas through the injection pipeline into the injection chamber;

(g) a choke associated with the injection pipeline, for regulating the flow of gas in the injection pipeline;

(h) a flow meter for measuring gas flow in the production chamber; and (i) a flow controller associated with the flow meter, wherein said flow controller comprises means for operating the choke and further comprises a computer with a memory, and wherein:

i.1 the flow controller is adapted to receive gas flow data from the meter, corresponding to total gas flow rates in the production chamber;

i.2 the memory is adapted to store a minimum total flow rate;

i.3 the computer is programmed to:

A. compare a total gas flow rate measured by the meter against the minimum total flow rate; and B. determine a minimum gas injection rate necessary to maintain the total gas flow rate in the production chamber at or above the minimum total flow rate; and i.4 the flow controller is adapted to automatically set the choke to permit gas flow into the injection chamber at a rate not less than the minimum gas injection rate.

21. The apparatus of claim 20 wherein the flow controller is a pneumatically-actuated flow controller.

22. The apparatus of claim 20 wherein the injection gas is a hydrocarbon gas.

23. The apparatus of claim 20 wherein the injection gas is recirculated production gas from the well.

24. The apparatus of claim 20 wherein the production chamber is the tubing, and the injection chamber is the annulus.

25. The apparatus of claim 20 wherein the production chamber is the annulus, and the injection chamber is the tubing.

26. An apparatus for producing natural gas from a well extending from ground surface into a subsurface production zone within a production formation, wherein:

(a) the wellbore is lined with a casing, said casing having perforations in the production zone;

(b) a tubing string extends through the casing and terminates adjacent to the production zone above the bottom of the wellbore;

(c) said casing defines an annulus between the tubing and the casing, the bottoms of said annulus and casing being in fluid communication with the well bore; and (d) a gas production pipeline is connected in fluid communication with the upper end of a production chamber selected from the tubing and the annulus;

said apparatus comprising:

(e) a gas injection pipeline having a first end connected in fluid communication with a source of pressurized injection gas, and a second end connected in fluid communication with an injection chamber selected from the tubing and the annulus, said injection chamber not being the production chamber;

(f) a choke associated with the injection pipeline, for regulating the flow of gas in the injection pipeline;

(g) a flow meter for measuring gas flow in the production chamber; and (h) a flow controller associated with the flow meter, wherein said flow controller comprises means for operating the choke and further comprises a computer with a memory, and wherein:

h.1 the flow controller is adapted to receive gas flow data from the meter, corresponding to total gas flow rates in the production chamber;

h.2 the memory is adapted to store a minimum total flow rate;

h.3 the computer is programmed to:

A. compare a total gas flow rate measured by the meter against the minimum total flow rate; and B. determine a minimum gas injection rate necessary to maintain the total gas flow rate in the production chamber at or above the minimum total flow rate; and h.4 the flow controller is adapted to automatically set the choke to permit gas flow into the injection chamber at a rate not less than the minimum gas injection rate.

27. The apparatus of claim 26 wherein the flow controller is a pneumatically-actuated flow controller.

28. The method of claim 26 wherein the injection gas is a hydrocarbon gas.

29. The apparatus of claim 26 wherein the injection gas is recirculated production gas from the well.

30. The apparatus of claim 26 wherein the production chamber is the tubing, and the injection chamber is the annulus.

31. The apparatus of claim 26 wherein the production chamber is the annulus, and the injection chamber is the tubing.

32. The apparatus of claim 26, further comprising an oxygen sensor adapted to detect the presence of oxygen within the production pipeline and to automatically shut down the compressor upon so detecting oxygen.

33. An apparatus for use in producing natural gas from a well extending from ground surface into a subsurface production zone within a production formation, wherein:

(a) the wellbore is lined with a casing, said casing having perforations in the production zone;

(b) a tubing string extends through the casing and terminates adjacent to the production zone above the bottom of the wellbore; and (c) said casing defines an annulus between the tubing and the casing, the bottoms of said annulus and casing being in fluid communication with the well bore;

said apparatus comprising:

(d) a gas compressor having a suction manifold and a discharge manifold;

(e) an upstream gas production pipeline having a first end connected in fluid communication with the upper end of a production chamber selected from the tubing and the annulus, and a second end connected in fluid communication with the suction manifold of the compressor;

(f) a downstream gas production pipeline having a first end connected in fluid communication with the discharge manifold;

(g) an auxiliary pipeline having a first end connected in fluid communication with the production pipeline at a point upstream of the compressor, and a second end connected in fluid communication with the production pipeline at a point downstream of the compressor;

(h) a gas injection pipeline having a first end connected in fluid communication with the auxiliary pipeline, and a second end connected in fluid communication with an injection chamber selected from the tubing and the annulus, said injection chamber not being the production chamber;

(i) a choke mounted in the injection pipeline, for regulating the flow of gas in the injection pipeline;

(j) a first flow valve mounted in the auxiliary pipeline between the point where the auxiliary pipeline connects with the production pipeline upstream of the compressor and the point where the injection pipeline connects with the auxiliary pipeline; and (k) a second flow valve mounted in the auxiliary pipeline between the point where the auxiliary pipeline connects with the production pipeline downstream of the compressor and the point where the injection pipeline connects with the auxiliary pipeline.

34. The apparatus of claim 33, further comprising a flow meter for measuring gas flow in the production chamber, and a flow controller associated with the flow meter, said flow controller having means for operating the choke.

35. The apparatus of claim 34 wherein the flow controller is a pneumatically-actuated flow controller.

36. The apparatus of claim 34 wherein the flow controller comprises a computer with a memory, and wherein:

(a) the flow controller is adapted to receive gas flow data from the flow meter, corresponding to total gas flow rates in the production chamber;

(b) the memory is adapted to store a minimum total flow rate;

(c) the computer is programmed to:

c.1 compare a total gas flow rate measured by the meter against the minimum total flow rate; and c.2 determine a minimum gas injection rate necessary to maintain the total gas flow rate in the production chamber at or above the minimum total flow rate; and (d) the flow controller is adapted to automatically set the choke to permit gas flow into the injection chamber at a rate not less than the minimum gas injection rate.

37. The apparatus of claim 34 wherein the meter is installed in the production pipeline at a point downstream of the compressor.

38. The apparatus of claim 34 wherein the meter is installed in the production pipeline at a point upstream of the compressor.

39. The apparatus of claim 33 wherein the production chamber is the tubing, and the injection chamber is the annulus.

40. The apparatus of claim 33 wherein the production chamber is the annulus, and the injection chamber is the tubing.

41. The apparatus of claim 33, further comprising an oxygen sensor adapted to detect the presence of oxygen within the production pipeline and to automatically shut down the compressor upon so detecting oxygen.

42. An apparatus for producing natural gas from a well extending from ground surface into a subsurface production zone within a production formation, wherein:

(a) the wellbore is lined with a casing, said casing having perforations in the production zone;

(e) a tubing string extends through the casing and terminates adjacent to the production zone above the bottom of the wellbore;

(f) said casing defines an annulus between the tubing and the casing, the bottoms of said annulus and casing being in fluid communication with the well bore; and (g) a gas production pipeline is connected in fluid communication with the upper end of a production chamber selected from the tubing and the annulus;

said apparatus comprising:

(e) a gas injection pipeline having a first end connected in fluid communication with a source of pressurized injection gas, and a second end connected in fluid communication with an injection chamber selected from the tubing and the annulus, said injection chamber not being the production chamber;

(f) a choke associated with the injection pipeline, for regulating the flow of gas in the injection pipeline;

(g) an oxygen sensor adapted to detect the presence of oxygen within the production pipeline and to automatically shut down the compressor upon so detecting oxygen.

* * * * *